US008256763B2

(12) United States Patent
Takamatsu

(10) Patent No.: US 8,256,763 B2
(45) Date of Patent: Sep. 4, 2012

(54) PAPER FEEDING APPARATUS AND IMAGE FORMING APPARATUS

(75) Inventor: Naritoshi Takamatsu, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 0 days.

(21) Appl. No.: 13/026,341

(22) Filed: Feb. 14, 2011

(65) Prior Publication Data

US 2011/0204559 A1 Aug. 25, 2011

(30) Foreign Application Priority Data

Feb. 19, 2010 (JP) ..... 2010-034267

(51) Int. Cl.
*B65H 1/00* (2006.01)

(52) U.S. Cl. ..... 271/145; 271/171

(58) Field of Classification Search ..... 271/145, 271/171; 399/393
See application file for complete search history.

(56) References Cited

U.S. PATENT DOCUMENTS

| | | | | |
|---|---|---|---|---|
| 7,216,864 | B2 * | 5/2007 | Yoshihara | 271/145 |
| 7,522,872 | B2 | 4/2009 | Fukuta | |
| 2010/0001460 | A1 * | 1/2010 | Kawarago | 271/162 |

FOREIGN PATENT DOCUMENTS

| | | | |
|---|---|---|---|
| JP | 6-27776 | U | 4/1994 |
| JP | 2004-352404 | A | 12/2004 |
| JP | 2006-232422 | A | 9/2006 |
| JP | 2010-58962 | A | 3/2010 |

* cited by examiner

*Primary Examiner* — David H Bollinger
(74) *Attorney, Agent, or Firm* — Keating & Bennett, LLP

(57) ABSTRACT

A paper feeding apparatus transports paper one by one through a transportation mechanism to an image forming unit of an image forming apparatus. The paper feeding apparatus includes a paper feed cassette to contain paper, a paper side guide arranged in the paper feed cassette to position the paper in a direction perpendicular or substantially perpendicular to a transport direction of the paper, and a dust removing roller arranged in the paper side guide and in contact with the paper contained in the paper feed cassette.

10 Claims, 8 Drawing Sheets

PAPER FEEDING APPARATUS AND IMAGE FORMING APPARATUS

CROSS-REFERENCE TO RELATED APPLICATIONS

This application claims priority under 35 U.S.C. 119 to Japanese Patent Application No. 2010-034267, filed on Feb. 19, 2010, which application is hereby incorporated by reference in its entirety.

BACKGROUND OF THE INVENTION

1. Field of the Invention

The present invention relates to a paper feeding apparatus configured to transport paper to an image forming unit of an image forming apparatus and an image forming apparatus including a paper feeding apparatus.

2. Description of the Related Art

An image forming apparatus, such as a copier, a facsimile machine, a multi-function peripheral, includes a paper feeding unit which transports paper to an image forming unit. A paper feeding unit includes a paper feed cassette and a pick up mechanism. For example, through the pick up mechanism, paper in the paper feed cassette is transported to a transportation path. And then, the paper is transported to the image forming unit.

Such an image forming apparatus causes false image formation or improper transportation when foreign substances such as paper dust are adhered to the paper. For example, when paper dust is adhered to a photosensitive drum of an image forming unit, it will interfere with forming an electrostatic latent image on the photosensitive drum, and cause false images such as black lines.

Paper dust which causes false images is produced during a transportation process inside the image forming apparatus, and also during a cutting process. The paper dust produced during the cutting process is often found on both edges of the paper, especially on both edges of the paper in a direction perpendicular to a transport direction of the paper (hereinafter: width direction). Therefore, conventionally, by arranging a dust removing roller in the transportation path in contact with the edges of the paper in the width direction, the paper dust is transferred to the dust removing roller and then is removed by a blade. It is also known to remove paper dust transferred from edges of the paper to a registration roller by a paper dust removing blade.

Conventionally, paper dust is removed from the paper by making a roller in contact with the paper. However, as described above, paper dust produced during the cutting process is often found on edges of the paper in a width direction, including surfaces of the portions having gone through the cut. Therefore, it is difficult to sufficiently remove paper dust adhered to edges of paper in a width direction simply by arranging a roller in contact with the surface of paper.

SUMMARY OF THE INVENTION

Preferred embodiments of the present invention sufficiently remove dust adhered to paper.

According to a preferred embodiment of the present invention, a paper feeding apparatus is configured to transport paper one by one through a transportation mechanism to an image forming unit of an image forming apparatus includes a paper feed cassette, a guide member and a dust removing roller. The paper feed cassette is configured to contain paper. The guide member is configured to position the paper in a direction perpendicular or substantially perpendicular to a transport direction of the paper. The dust removing roller is arranged in the guide member and in contact with the paper contained in the paper feed cassette.

Here, the dust removing roller is arranged in the guide member which positions the paper in the direction perpendicular or substantially perpendicular to the transport direction of the paper (hereinafter: a width direction). The paper is transported to the image forming unit by a transportation mechanism while the edges of paper in the width direction are in contact with the dust removing roller. Accordingly, by arranging the paper to be in contact with the dust removing roller, dust adhered to the edges of paper in the width direction is removed in the paper feed cassette.

As described above, paper dust produced during the cutting process is often found on edges of the paper in the width direction. Therefore, by arranging the dust removing roller to be in contact with edges of paper, it becomes highly effective to remove paper dust sufficiently. Further, because paper dust produced during the cutting process is removed before the paper is transported into the transportation path of the image forming apparatus, the dust hardly gets into the image forming unit of the image forming apparatus.

The dust removing roller preferably is a conductive roller, for example, and can be set at a prescribed electrical potential. Here, the dust removing roller is a conductive roller at a prescribed electrical potential. Therefore, even when the paper is charged, the dust removing roller can attract and remove dust from the paper easily. In addition, the conductive roller can be set at a frame ground potential in the image forming apparatus. Also, the conductive roller can be set at a prescribed bias potential.

It is preferable that the paper feeding apparatus also include a blade member and a dust containing member. The blade member is preferably arranged in the guide member with one edge of the blade member in contact with a roller surface of the dust removing roller. The dust containing member contains dust removed from the roller surface by the blade member. Here, by arranging the blade member with one edge thereof in contact with the roller surface of the dust removing roller, dust is removed from the roller surface. Therefore, it can prevent dust on the roller surface from adhering back to paper in the paper feed cassette. Further, by providing the dust containing member, dust removed by the blade member is contained securely therein.

In another preferred embodiment of the present invention, an image forming apparatus includes the above-described paper feeding apparatus and an image forming unit which performs image formation on the paper transported from the paper feeding apparatus.

In various preferred embodiments of the present invention, the image forming apparatus can sufficiently remove dust on edges of paper in the paper feed cassette by providing the dust removing roller in the guide member of the paper feeding apparatus.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
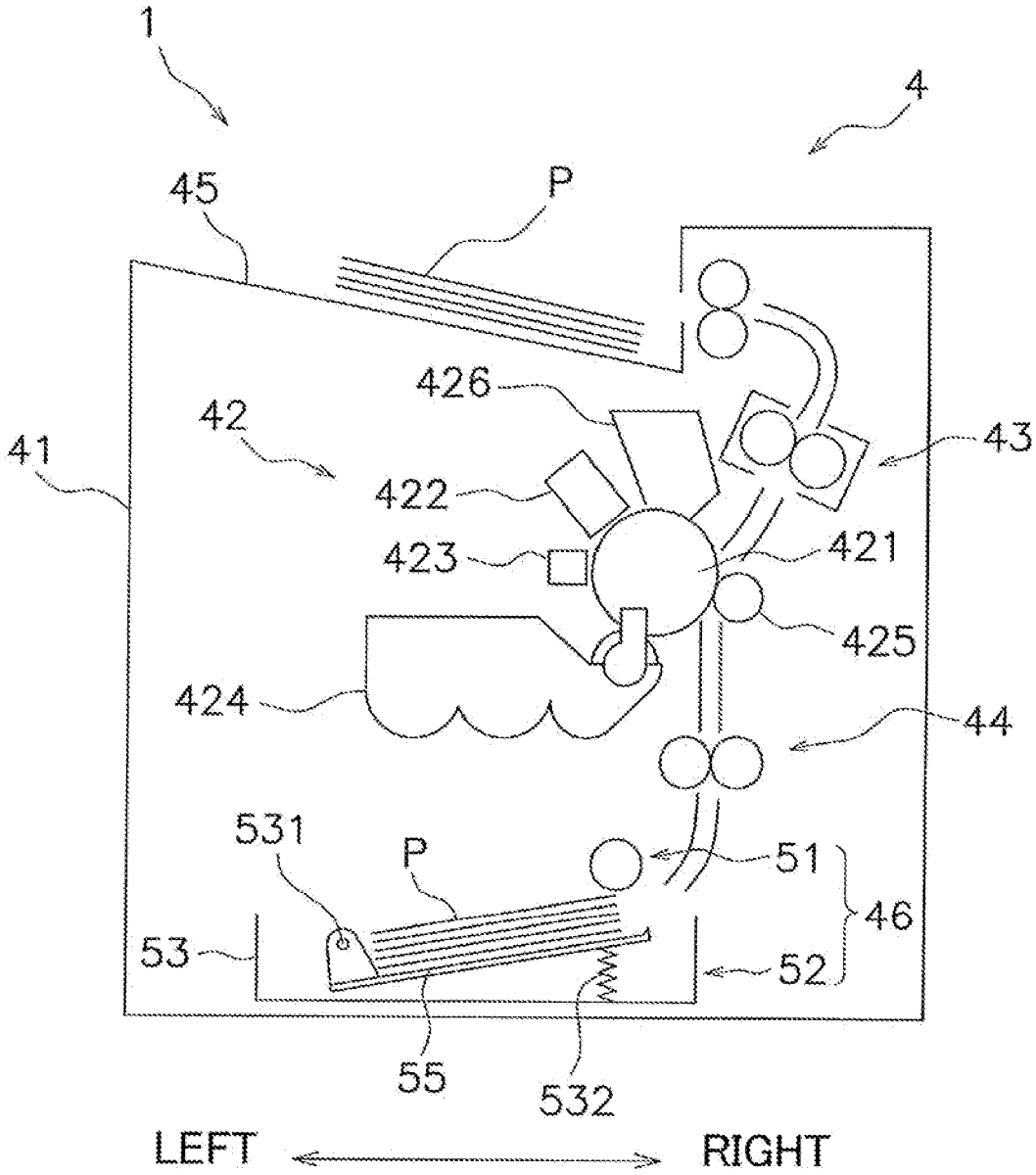
FIG. 1 is a view which illustrates a configuration of an image forming apparatus.

In one preferred embodiment of the present invention, an image forming apparatus preferably used as a printer, for example, will be described with reference to FIG. 1. FIG. 1 is a view which illustrates a configuration of an image forming apparatus. An image forming apparatus 1 preferably includes a chassis 41, in which an image forming unit 42, a fusing unit 43, a paper transportation unit 44, a paper ejecting unit 45 and a paper feeding apparatus 46 are provided. Hereinafter, to clarify the relationship between each direction with respect to the image forming apparatus 1, a direction in which paper in the paper feeding apparatus 46 is transported is regarded as a longitudinal or transport direction, and a direction perpendicular or substantially perpendicular to the horizontal direction which indicates the back and the front of the apparatus is regarded as a width direction.

An image forming unit 42, for example, forms images on paper P according to an image data transmitted from a personal computer. An image forming unit 42 includes a photosensitive drum 421, a charger 422, an exposure head 423, a developing unit 424, a transfer roller 425 and a cleaner 426.

A photosensitive drum 421 is configured to form an electrostatic latent image on its surface. The photosensitive drum 421 preferably is a cylindrical and rotatable unit. Through a drive unit (not illustrated), the photosensitive drum rotates in a counterclockwise direction on an axis perpendicular or substantially perpendicular to a transport direction of the paper illustrated in FIG. 1. The charger 422, the exposure head 423, the developing unit 424, and the transfer roller 425 are arranged according to the rotating direction of the photosensitive drum 421 in the same order as described above.

The charger 422 is configured to charge the surface of the photosensitive drum 421 homogeneously. The charger 422, for example, preferably is a corona discharged apparatus. The exposure head 423 is configured to form an electrostatic latent image according to an image data by irradiating the surface of the photosensitive drum 421. The exposure head 423 may include, for example, an LED (Light Emitting Diode) as light source.

The developing unit 424 is configured to supply tonner to an electrostatic latent image on the photosensitive drum 421 and develop the image. The transfer roller 425, set opposite to the photosensitive drum 421, is configured to transfer a tonner image from the photosensitive drum 421 to paper P. The cleaner 426 is configured to remove tonner left on the photosensitive drum 421.

The fusing unit 43 preferably includes a heat roller and a pressure roller. The fusing unit 43 is configured to provide heat and pressure to paper P so as to fix a tonner image thereon.

The paper transportation unit 44 preferably includes a transportation path and a plurality of rollers. The paper transportation unit 44 is configured to transport paper P using the rollers via the transportation path, i.e., from the paper feed cassette 52 of the paper feeding device 46 (to be described later) to the paper ejecting unit 45 through the image forming unit 42 and the fusing unit 43. The paper ejecting unit 45 is configured to eject paper P which has an image formed thereon. The paper ejecting unit 45 is provided on the top of the chassis 41.

Figure 2:
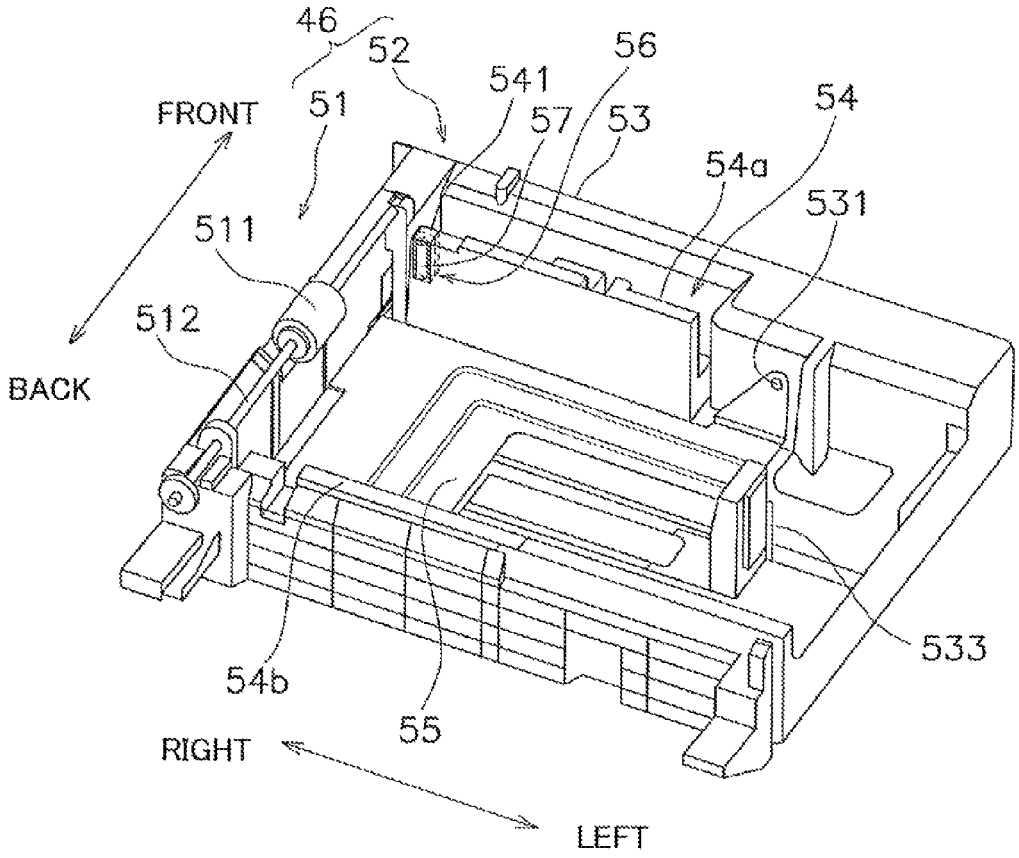
FIG. 2 is a perspective view of a paper feeding apparatus when no paper is placed.

The paper feeding apparatus 46, configured to contain a stack of paper P before image formation, transports the paper one by one to the image forming unit 42. With reference to FIG. 2, the paper feeding apparatus 46 will be described. FIG. 2 is a perspective view of the paper feeding apparatus when no paper is placed. The paper feeding apparatus 46 includes a transportation mechanism 51 and a paper feed cassette 52. The transportation mechanism 51 is configured to transport paper P in the paper feed cassette 52 to the paper transportation unit 44 one by one. The transportation mechanism 51 includes a pick up roller 511, a drive shaft 512 and a drive unit (not illustrated). The transportation mechanism 51 transports the paper at the top of paper P in the paper feed cassette 52 to the paper transportation unit 44 wherein the drive unit drives the pick up roller 511.

The paper feed cassette 52 contains a stock of paper P before image formation. The paper feed cassette 52 can contain different sizes of paper P. The paper feed cassette 52, which can be taken in and out in a horizontal direction with respect to the chassis 41, includes a paper feed cassette main body 53, a paper side guide 54 and a flapper 55.

The paper feed cassette main body 53, configured to contain a stack of paper P, includes a bottom wall and side walls. The paper side guide 54 is configured to position the paper P in a direction perpendicular or substantially perpendicular to a transport direction of the paper (hereinafter: the width direction). In a preferred embodiment of the present invention, the paper side guide 54, arranged in the paper feed cassette main body 53, includes a pair of paper side guides 54*a* and 54*b* arranged in the width direction. The paper side guide 54, depending on the size of paper P, is arranged in the paper feed cassette main body 53 to be movable in the width direction.

As illustrated in FIG. 1, the flapper 55 is arranged to rotate up and down on a point of support of a pivot pin 531. By being urged upward by a pressure spring 532, the flapper 55 can be maintained in a position that allows the pick up roller 511 to be in contact with the top of paper while holding plural pieces of paper. Further, in the paper feed cassette main body 53, a rear paper guide 533 is configured to control the rear position of paper P in the transport direction of the paper.

Figure 3:
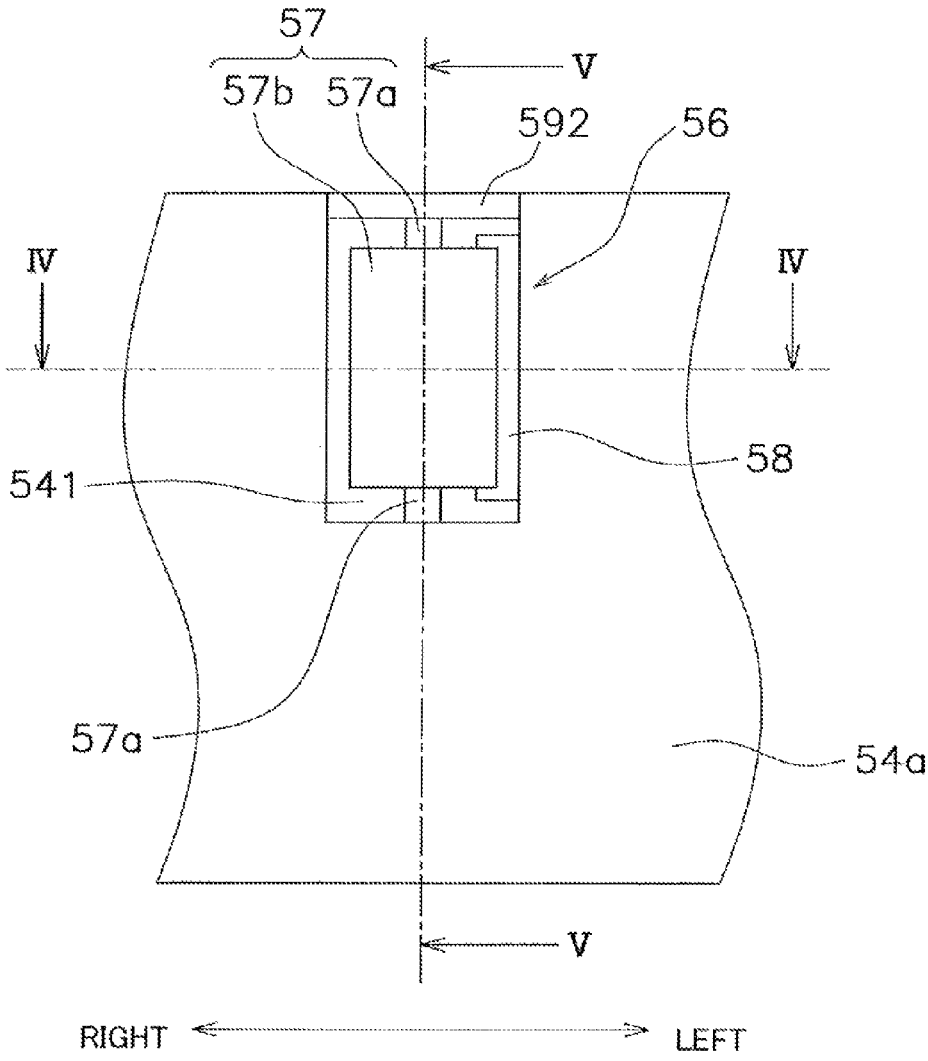
FIG. 3 is a front view of a dust removing mechanism and its periphery.
Figure 4:
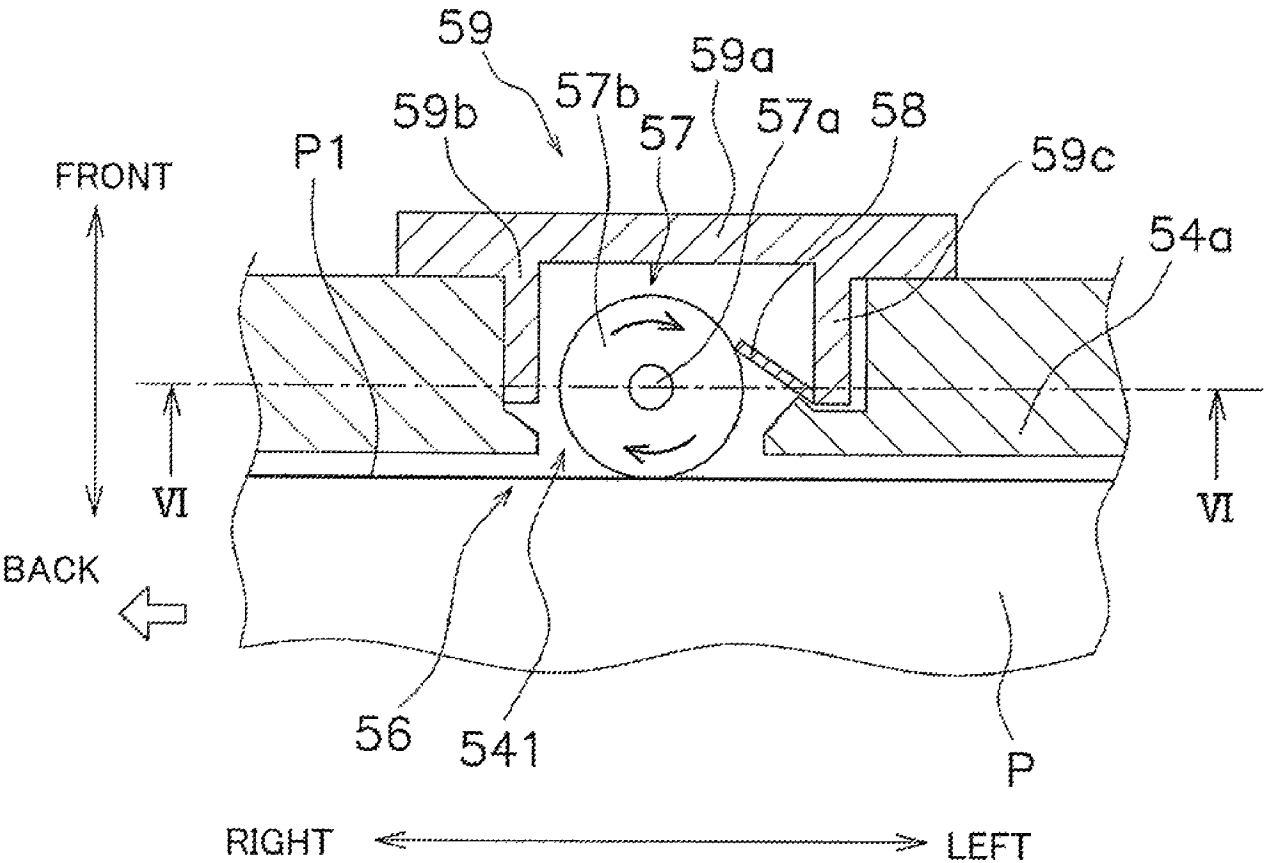
FIG. 4 is a cross sectional view of FIG. 3 along the line IV-IV.
Figure 5:
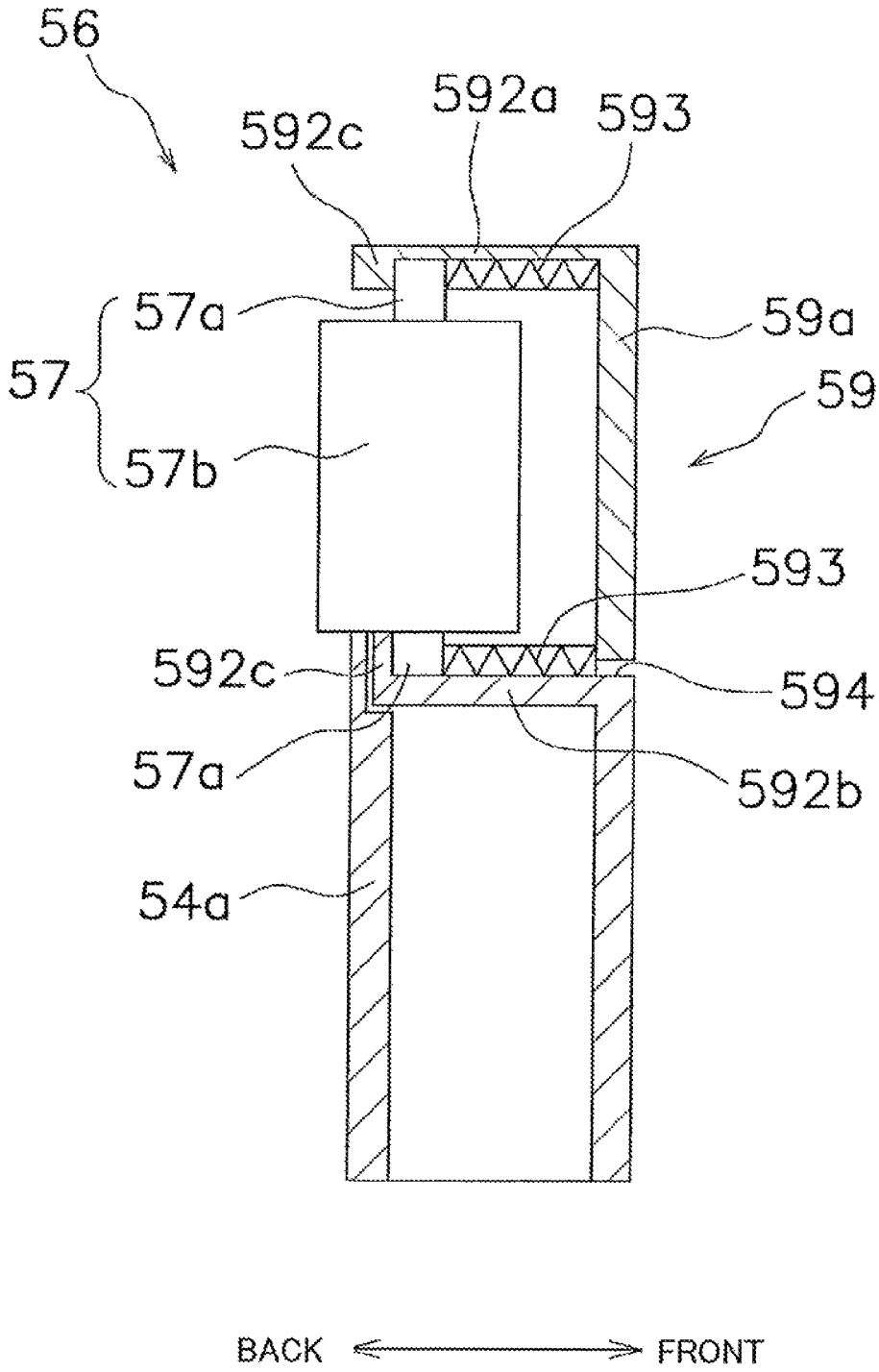
FIG. 5 is a vertical cross sectional view of FIG. 3 along the line V-V.
Figure 6:
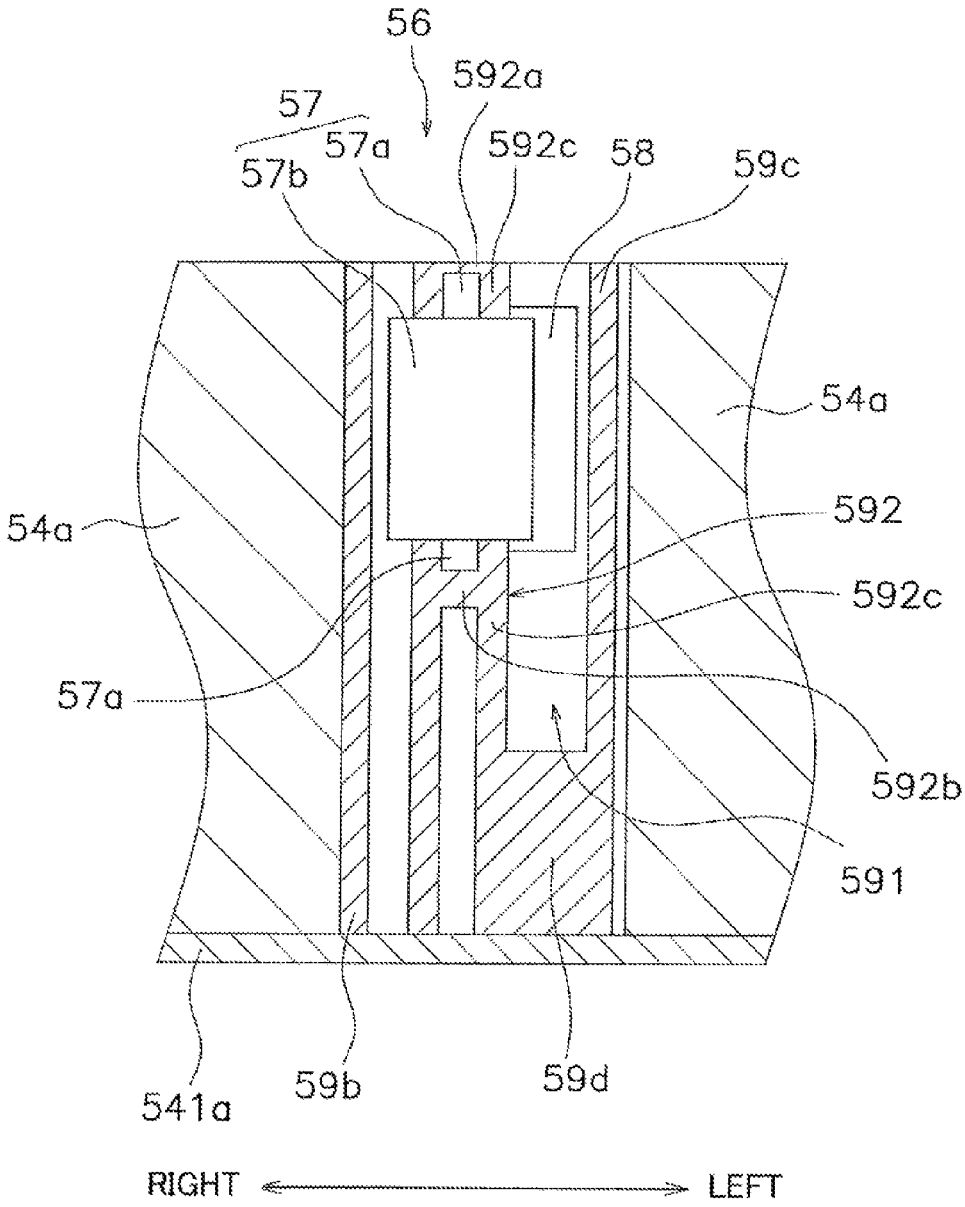
FIG. 6 is a vertical cross sectional view of FIG. 4 along the line VI-VI.

With reference to FIG. 3, FIG. 4, FIG. 5 and FIG. 6, a dust removing mechanism arranged in the paper side guide 54 will be described. FIG. 3 is a front view of the dust removing mechanism and its periphery. FIG. 4 is a cross sectional view of FIG. 3 along the line IV-IV. FIG. 5 is a vertical cross sectional view of FIG. 3 along the line V-V. FIG. 6 is a vertical cross sectional view of FIG. 4 along the line VI-VI.

In a preferred embodiment of the present invention, one dust removing mechanism is arranged for each of the paper side guide 54*a* and the paper side guide 54*b*. Hereinafter, a dust removing mechanism arranged in the paper side guide 54*a* will be described as an example, and a description of a dust removing mechanism 56 arranged in the paper side guide 54*b* will be omitted. Also hereinafter, paper dust means the paper dust produced during the cutting process and paper dust inside of the paper feed cassette.

The paper side guide 54*a* includes a storage unit 541 wherein the dust removing mechanism is arranged. The storage unit 541 is arranged in the upper half of the paper side guide 54*a* around the transportation mechanism 51. The storage unit 541 is an aperture which runs along the width direction.

The dust removing mechanism 56 is configured to remove dust adhered to edges of paper P in the paper feed cassette 52 in the width direction. The dust removing mechanism 56, arranged in the storage unit 541, includes a dust containing unit 59, a dust removing roller 57 and a dust removing blade 58.

The dust containing unit 59 is configured to contain dust removed from the dust removing roller by the dust removing blade and is installed at the front of the storage unit 541. The dust containing unit 59 can be removed frontward from the storage unit 541. Furthermore, the dust containing unit 59 rotatably supports the dust removing roller 57. The dust containing unit 59 preferably has a container configuration that is preferably made by connecting each rear surface (not illustrated) of a front surface 59*a*, a right side surface 59*b*, a light side surface 59*c*, a bottom surface 59*d* and a rear surface (not shown) opposing to the front surface 59*a*. As illustrated in FIG. 6, the front surface 59*a*, the left side surface 59*c*, the bottom surface 59*d* and a bearing member 592 (described later) defines a space that is a containing room 591.

The containing room 591 is configured to contain the dust removed from the dust removing roller 57 by the dust removing blade 58 and the dust dropped due to its own weight from the dust removing blade 58. As clearly illustrated in FIG. 6, the containing room 591 is preferably arranged around the right side of the left side surface 59*c*. However, the formation of the containing room 591 is not limited to the above-described one.

The dust containing unit 59 also includes the bearing member 592. The bearing member 592 rotatably supports both ends of the dust removing roller 57 in an axial direction. As illustrated in FIG. 5 and FIG. 6, the bearing member 592 is arranged between the right side surface 59*b* and the left side surface 59*c*, protruding backward from the front surface 59*a*. The bearing member 592 includes an upper bearing 592*a* and a lower bearing 592*b* which are arranged in respective sides of the dust removing roller 57. Both the upper bearing 592*a* and the lower bearing 592*b* include walls on its back and two sides, and include a supporting member 592*c* which opens only in the front.

The dust removing roller 57 is configured to remove dust adhered to the edges of paper P in the width direction. As illustrated in FIG. 4, the dust removing roller 57 is arranged between the right side surface 59*b* and the left side surface 59*c*, and also between the upper bearing 592*a* and the lower bearing 592*b*. More specifically, the dust removing roller 57 includes a shaft 57*a* and a cylindrical roller 57*b* arranged around the shaft 57*a*. The roller 57*b* is fixed on the shaft 57*a*, and the roller 57*b* and the shaft 57*a* rotate integrally. In a preferred embodiment, the dust removing roller 57 preferably is a conductive roller, with the roller 57*b* including conductive resin and the shaft 57*a* being made from metal. The roller 57*b* and the shaft 57*a* can be integrally molded with conductive resin, for example. The axial ends of the shaft 57*a* are rotatably supported by the upper bearing 592*a* and the lower bearing 592*b* of the bearing member 592.

The dust removing blade 58, arranged to be in contact with a roller surface of the dust removing roller 57 with a prescribed pressure, removes dust adhered thereto. The dust removing blade 58 is vertically elongated so as to be fully in contact with the dust removing roller 57 in an axial direction. In order not to interfere with the rotation of the dust removing roller 57, the dust removing blade 58 preferably has a sheet configuration and is preferably made of elastic materials, such as urethane or polyethylene terephthalate (PET), for example. The dust removing edge preferably includes a first edge supported by the end of the left side surface 59*c*, and a second edge arranged to be in contact with the roller surface of the dust removing roller 57 at a prescribed angle.

More specifically, the dust removing blade 58 is placed between the dust removing roller 57 and the left side surface 59*c*, and the second edge of the dust removing blade 58 is arranged to be in contact with the left side of the dust removing roller 57. Because the dust removing blade 58 is arranged above the containing room 591 (described above), dust removed by the dust removing blade 58 is surely contained in the containing room 591.

The dust removing mechanism 56 also includes a pressure spring 593. The pressure spring 593 is an urging member which keeps the dust removing roller 57 at a rotating position. As illustrated in FIG. 5, the pressure spring 593 preferably includes a pair of members, arranged respectively under the upper bearing 592*a* and above the lower bearing 592*b*. The pressure spring 593 includes a first edge arranged to be in contact with the shaft 57*a* of the dust removing roller 57, and a second edge arranged to be in contact with the front surface 59*a* of the dust containing unit 59.

The shaft 57*a* of the dust removing roller 57 can rotate in a position where the shaft 57*a* is in contact with supporting members 592*c* preferably provided respectively in the upper bearing 592*a* and in the lower bearing 592*b*. In the above-described state, as illustrated in FIG. 5, when the dust containing unit 59 is arranged in the storage unit 541, a portion of the dust removing roller 57 protrudes backward from the rear side surface of the paper side guide 54*a*. The protruding portion of the roller surface of the dust removing roller 57 is preferably arranged so as not to interfere with the transportation of paper P in the paper feed cassette 52.

Figure 7:
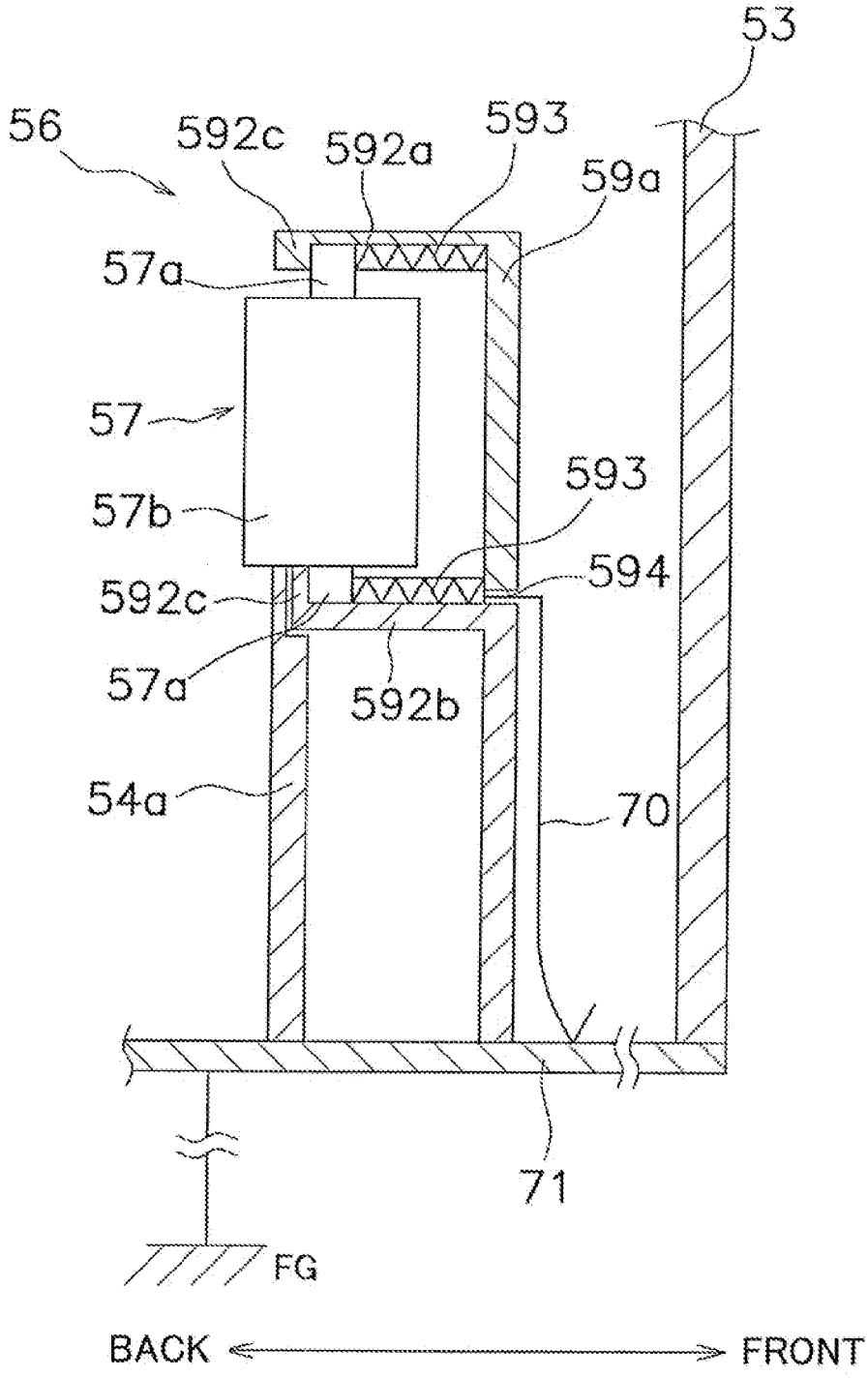
FIG. 7 is a wire diagram of a dust removing roller and a frame ground.

The dust removing roller 57 is electrically connected to the chassis 41 of the image forming apparatus 1 via the pressure spring 593 and a wire 70. That is, the electric potential of the dust removing roller 57 is set at the frame ground potential. A wiring route between the paper removing roller 57 and the frame ground will be described with reference to FIG. 7. FIG. 7 is a wire diagram of the dust removing roller and the frame ground.

One side of the wire 70 is connected to the pressure spring 593 and extends through a wiring line hole 594 formed in the front surface 59*a*. The other side is connected to a conducting board 71 arranged at the bottom of the paper feed cassette main body 53. The conducting board 71 is connected to the chassis 41 via a conducting spring or the like (not illustrated). Accordingly, the electrical potential of the dust removing roller 57 is set at the frame ground potential.

Next, dust removing operation for dust adhered to paper P will be described. When transporting paper, the paper feeding apparatus 46 rotates the pick up roller 511 and, by the feeding frictional force of the pick up roller 511, separates each piece of paper contained in the paper feed cassette 52 into the paper transportation unit 44.

In this operation, as illustrated in FIG. 4, the paper is transported to the right side, while the edge P1 of paper P in the width direction being in contact with the roller surface of the dust removing roller 57 of the dust removing mechanism 56. Because of the contact, dust adhered to both edges of paper P can be transferred to the roller surface of the dust removing roller 57. The dust removing roller 57, as illustrated in FIG. 4, rotates in the clockwise direction through the frictional resistance of paper P. The dust adhered to the roller surface of the dust removing roller 57 is removed by the dust removing blade 58. And then, the removed dust drops into the dust containing room 591 of the dust containing unit 59 due to its own weight.

In the above described operation, the dust removing roller 57 is set at the frame ground potential. Therefore, even if dust in the paper feed cassette is electrically charged, due to the electrical potential difference between the dust removing roller 57 and the dust, the dust adhered to the paper P can be transferred to the dust removing roller 57 easily.

The dust removing roller 57 is arranged in the paper side guide 54 which can position paper P in the width direction of paper P in the paper feed cassette 52 such that the dust removing roller 57 can contact with paper P in the paper feed cassette 52. Accordingly, when transporting paper, the dust removing roller 57 can be in contact with the edges of paper P in the width direction and remove dust adhered thereto. That is, dust adhered during the cutting process can be removed from paper P within the paper feed cassette 52.

Because paper dust produced during the cutting process of paper P is often found on both edges of paper P in the width direction, including surfaces of the portions having gone through the cut, by arranging the dust removing roller 57 in contact with both edges of paper P in the width direction, it becomes highly effective to remove paper dust. Further, because the paper dust adhered to paper P during the cutting process is already removed before paper P is transported into the paper transportation unit 44 of the image forming apparatus 1, the paper dust hardly gets into the image forming unit 42. As a result, image quality improves due to the reduction of paper dust. Furthermore, when a blade unit to remove paper dust is arranged at a roller of the paper transportation unit 44, it will reduce the burden of the blade unit and the like, and lengthen its life span.

Also, the paper side guide 54 arranged with the dust removing roller 57 is movable according to the width of paper. Therefore, regardless of the width of paper P, dust adhered to the edges of paper P in the width direction can be removed in the paper feed cassette 52.

The dust removing roller 57 is preferably maintained at the frame ground potential. Accordingly, when dust in the paper feed cassette is electrically charged, dust can be transferred to the dust removing roller by the static electricity. As a result, dust adhered to the edges of paper P in the width direction can be removed efficiently.

By providing the dust removing blade 58, dust adhered to the roller surface of the dust removing roller can be removed. Accordingly, it prevents dust adhered to the roller surface of the dust removing roller 57 from adhering back to paper P in the paper feed cassette 52. Further, by providing the containing room 591, the dust removed by the dust removing blade 58 can be positively contained.

The dust containing unit 59, which is removable, is arranged in the width direction of the storage unit 541 of the paper side guide 54. Accordingly, when dust is accumulated therein, a user can easily take the dust containing unit 59 out of the storage unit 541 so as to discard the dust.

One preferred embodiment of the present invention has been described above. However, the present invention is not limited to the above-described preferred embodiment, and it is possible to be modified in various ways without departing from the scope of the invention.

In the above-described preferred embodiment, the image forming apparatus has been described as a printer, for example. However, the present invention is not limited to this, and can also be applied to an image forming apparatus which has the functions of an image reading apparatus and a printer. Further, the present invention can be applied to an image forming apparatus such as an MFP (multifunction peripheral) which has a facsimile function and a communication function.

In the pair of paper side guides, a plurality of dust removing mechanisms may be arranged in each paper side guide. Also, more than one dust removing mechanism may be arranged in only one paper side guide.

The dust removing roller needs to be rotatable when in contact with the edge of the paper in the width direction, but is not limited to a conductive roller. For example, the roller may be formed with a belt around a center shaft.

When transporting paper, only the paper at the top is in contact with the dust removing roller. Therefore, it is possible to shorten the vertical length of the dust removing roller to correspond only to the upper portion of paper. The shorter the length of the dust removing roller, the less resistance would be resulted from the paper. Therefore, the dust removing roller would be more easily rotatable. However, on the other hand, if the resistance of the paper is too small, it is also possible to lengthen the vertical length of the dust removing roller. For example, it may be lengthened to reach the height of the paper side guide.

Figure 8:
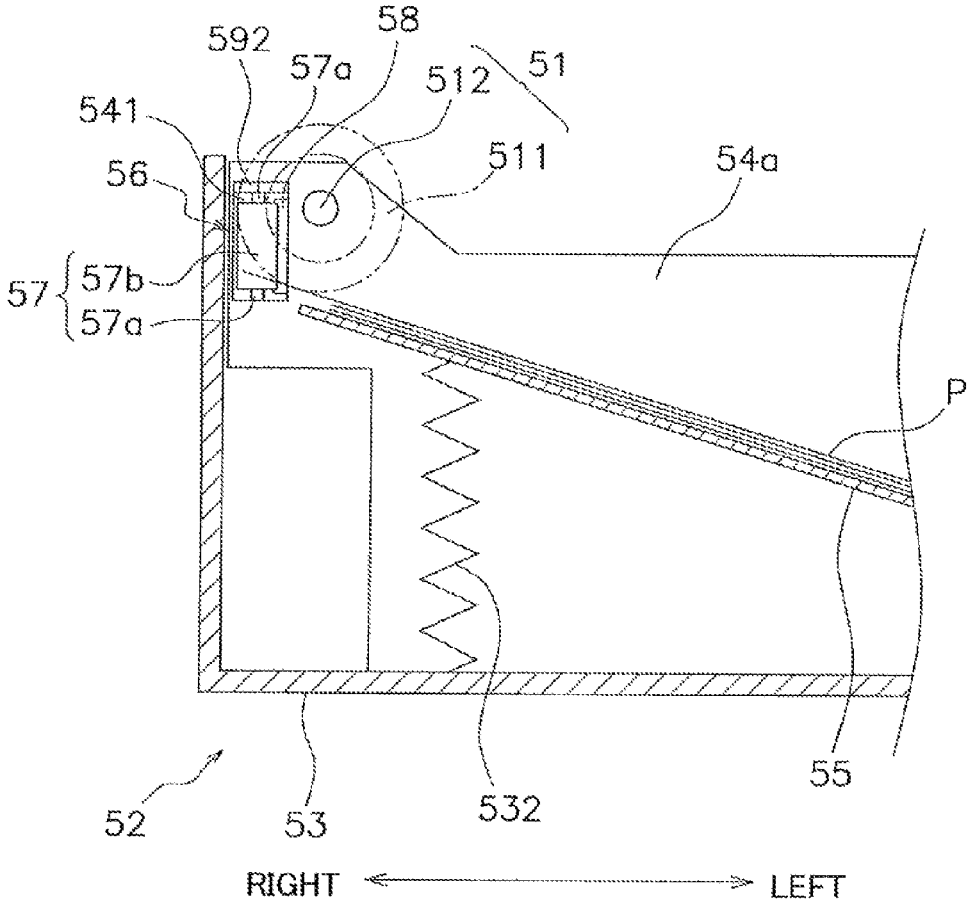
FIG. 8 is a sectional view of a paper feeding apparatus which illustrates an example of the location of a dust removing mechanism in another preferred embodiment of the present invention.

In the paper side guide, the dust removing mechanism may be arranged in a downstream of the pick up roller in the paper transportation direction, and can be arranged to be in contact with the paper transported by the pick up roller. FIG. 8 is a sectional view of a paper feeding apparatus which illustrates an example of the location of a dust removing mechanism in another preferred embodiment of the present invention. In addition, the configuration except the arrangement of the dust removing mechanism in the paper side guide is preferably the same or substantially the same as the above-described preferred embodiment. Therefore, given the same reference numerals of the above described preferred embodiment, the details of the description will be omitted.

As illustrated in FIG. 8, a dust removing mechanism 56 in a paper side guide 54*a* is arranged downstream of a drive shaft 512 of the pick up roller 511 in the paper transportation direction. More specifically, the dust removing mechanism is arranged to be in contact with the paper P transported by the pick up roller 511 from a lifting board urged upward by a pressure spring 532. By arranging the dust removing mechanism in this position, the dust removing mechanism can be in contact with each piece of paper P transported by the pick up roller 511. Accordingly, as less resistance of paper P is achieved, it makes the dust removing roller 57 rotate more easily and makes it possible to remove dust adhered to the edges of paper P in the width direction more efficiently.

In the above-described preferred embodiment, it has been described that the dust removing roller 57 is preferably arranged in the dust containing unit 59 as an example. However, the present invention is not limited to this. For example, the dust removing roller may be supported by a paper side guide so as to be rotatable.

In the above-described preferred embodiment, it has been described that the dust removing roller 57 is preferably set at the frame ground potential as an example. However, the dust removing roller may be connected to a power supply circuit (not illustrated) via the pressure spring and the wire. Further, a bias voltage opposite to the potential of dust can be applied to the dust removing roller via the power supply circuit. Accordingly, by providing the dust removing roller with a prescribed bias voltage, dust adhered to the edges of paper in the width direction can be transferred to the dust removing roller more effectively.

In the above-described preferred embodiment, a non-driven dust removing roller 57 has been described. However, a dust removing roller may be driven by a motor arranged in the paper feed cassette. Further, dust adhered to paper may be removed by rotating the dust removing roller routinely. For example, when restocking paper, the dust removing roller may be rotated. Furthermore, when a prescribed number of pieces of paper are transported into the transportation unit by the paper transporting mechanism, the dust removing roller may be rotated.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A paper feeding apparatus for transporting paper one by one through a transportation mechanism to an image forming unit of an image forming apparatus, the paper feeding apparatus comprising:

a paper feed cassette configured to contain paper;

a paper side guide arranged in the paper feed cassette to position the paper in a direction perpendicular or substantially perpendicular to a transport direction of the paper; and a dust removing roller arranged in the paper side guide, the dust removing roller being in contact with the paper contained in the paper feed cassette.

2. A paper feeding apparatus according to claim 1, wherein the dust removing roller is a conductive roller set at a prescribed electrical potential.

3. A paper feeding apparatus according to claim 2, wherein the conductive roller is set at a frame ground potential.

4. A paper feeding apparatus according to claim 1, further comprising:

a blade member arranged in the paper side guide with one edge of the blade member being in contact with a roller surface of the dust removing roller; and a dust containing unit configured to contain dust removed from the roller surface by the blade member.

5. A paper feeding apparatus according to claim 1, further comprising:

a pressure spring configured to urge the dust removing roller toward the paper.

6. An image forming apparatus comprising:

an image forming unit;

a transportation mechanism configured to transport paper one by one to the image forming unit;

a paper feed cassette configured to contain the paper;

a paper side guide arranged in the paper feed cassette to position the paper in a direction perpendicular or substantially perpendicular to a transport direction of the paper; and a dust removing roller arranged in the paper side guide and in contact with the paper contained in the paper feed cassette.

7. An image forming apparatus according to claim 6, wherein the dust removing roller is a conductive roller set at a prescribed electrical potential.

8. An image forming apparatus according to claim 7, where in the conductive roller is set at a frame ground potential.

9. A paper feeding apparatus according to claim 6, further comprising:

a blade member arranged in the paper side guide with one edge of the blade member being in contact with a roller surface of the dust removing roller; and a dust containing unit configured to contain dust removed from the roller surface by the blade member.

10. A paper feeding apparatus according to claim 6, further comprising:

a pressure spring configured to urge the dust removing roller toward the paper.

* * * * *